United States Patent [19]

Frosch et al.

[11] 4,074,395

[45] Feb. 21, 1978

[54] WEB LAYERING DEVICE

[75] Inventors: Werner Frosch, Beckedorf; Wolfgang Uliczka, Bremen, both of Germany

[73] Assignee: Fried. Krupp Gesellschaft mit beschrankter Haftung, Essen, Germany

[21] Appl. No.: 740,213

[22] Filed: Nov. 9, 1976

[30] Foreign Application Priority Data

Nov. 19, 1975 Germany ..... 2551898

[51] Int. Cl.[2] ..... B65H 45/103

[52] U.S. Cl. ..... 19/163

[58] Field of Search ..... 19/160, 161 R, 163, 19/155; 28/1 CL; 226/113, 119

[56] References Cited

U.S. PATENT DOCUMENTS 938,437 10/1909 Scribner ..... 19/163

3,903,569 9/1975 Brandis ..... 19/163

FOREIGN PATENT DOCUMENTS 4,273 of 1874 United Kingdom ..... 19/163

*Primary Examiner*—Dorsey Newton

*Attorney, Agent, or Firm*—Spencer & Kaye

[57] ABSTRACT

In a web layering device composed of a series of conveyors disposed in sequence for conveying a web of textile fibers from a card and depositing the web in layered form on a transporting unit, at least some of the conveyors being mounted on carriages to undergo back and forth movement, the attainable web conveying speed is increased by disposing an air guidance member in the form of a plate at at least one region of transfer between two conveyors to create an air stream which travels substantially tangentially to the web travel path.

12 Claims, 1 Drawing Figure

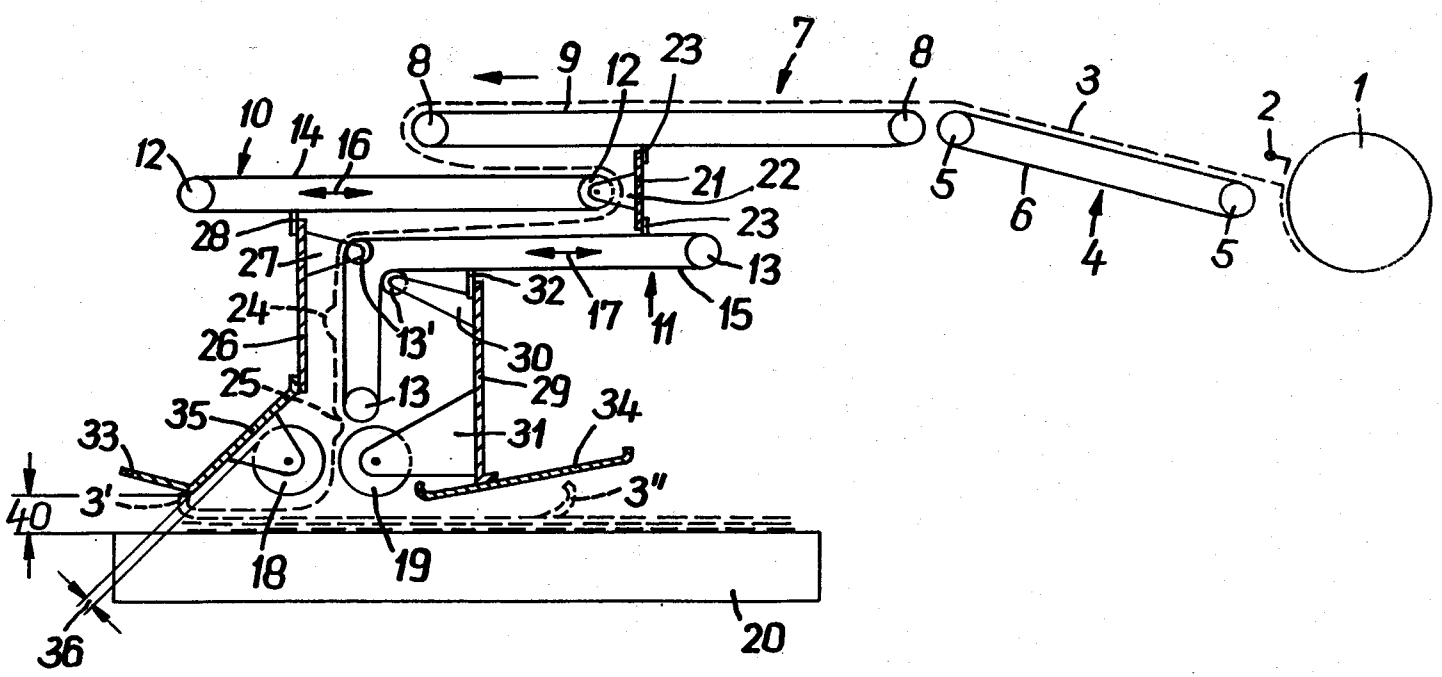
1
2
3
4
5
6
7
8
9
10
11
12
13
13'
14
15
16
17
18
19
20
21
22
23
24
25
26
27
28
29
30
31
32
33
34
35
36
3'
3"
40

WEB LAYERING DEVICE

BACKGROUND OF THE INVENTION

The present invention relates to a web layering device of the type including a plurality of sequentially disposed individual layering tables, or carriages, mounted to undergo back and forth movement, a stationary feed unit cooperating with the first layering table in the sequence, and a removal unit associated with a transporting unit for the web.

In known web layering units including individual layering tables, i.e., layering tables having single layering belts, the speed at which the web can be conveyed is limited to 40 to 60 m/min, depending on the fineness of the fiber material involved. At higher conveying speeds, the web will in part be lifted away from the layering tables, under the influence of an air stream produced by movement of the tables, so that the formation of wrinkles is possible.

In the case of ribbon layers, the web is guided between two sheets moved in the same direction so that no danger of lifting exists and consequently a higher production speed is possible. However, the drawback of the ribbon layers is, in particular, that the web is bunched at the points of direction reversal of the sheets and consequently is wrinkled, particularly if fine fiber material is involved. A further drawback of this type of device is that it affords poor accessibility on the occasion of malfunctions, for example when overlapping of the web occurs.

SUMMARY OF THE INVENTION

It is an object of the present invention to eliminate the above-noted shortcoming of web layering devices composed of individual layering tables by influencing the air streams occurring during the layering process in such a manner as to permit perfect web deposition at significantly increased layering speeds of up to, for example, 80 to 100 m/min.

This and other objects of the invention are accomplished in a machine for layering a web of textile fibers composed of a plurality of web conveying units including a stationary web delivery unit, a first layering carriage unit mounted to undergo a back and forth movement and to receive a fiber web from the delivery unit, a further layering carriage unit disposed in sequence with the first layering carriage unit and mounted to undergo a back and forth movement, an additional layering unit movable together with the further layering carriage unit for conveying a web away from the further layering carriage unit, and a transporting unit for transporting a layered web from the additional layering means, by the provision of air guidance means located at the region of transfer of such a web between two of the units for forming an air guidance channel with the two units to create during conveyance of a web in a web layering procedure, an air stream traveling substantially tangentially to the direction of travel of the web.

In a preferred embodiment of the web layering device, the air guidance members are constituted by plates which are stationary with respect to the locations at which the direction of web advance is changed.

The plates may be fastened in a simple manner to those transporting devices which do not move with respect to such direction change locations.

The effectiveness of the air guidance produced by the plates can be increased by providing them with sealing strips at those locations which are adjacent surfaces of the transporting units which move with respect to the plates.

According to a further feature of the present invention, foot plates are provided on both sides of the removal unit, which unit includes removal rollers. These footplates are inclined, at most, to a slight extent with respect to the supporting surface for the web on the transporting unit and are slightly spaced from the latter.

The distance between the foot plates and the supporting surface of the transporting unit is preferably no greater than 60 mm.

It has been found to be particularly advantageous to arrange the foot plates in such a manner that they are inclined at an angle of no more than 25° with respect to such supporting surface.

BRIEF DESCRIPTION OF THE DRAWING

The sole FIGURE is a simplified, elevational, cross-sectional view of a preferred embodiment of a web layering device provided with air guidance members according to the invention.

DESCRIPTION OF THE PREFERRED EMBODIMENTS

In the apparatus shown in the FIGURE, a web 3 removed from a card 1 by means of a doffer 2 is conducted by a first delivery table 4 composed of belt rollers 5 and a delivery belt 6, to a second delivery table 7 composed of belt rollers 8 and a delivery belt 9. From table 7, web 3 is conducted into the region of two sequentially arranged layering tables, or carriages, 10 and 11, table 10 including guide rollers 12, and a layering belt 14, and table 11 including guide rollers 13 and layering belt 15.

During the layering process, layering tables 10 and 11 each undergoes a back and forth movement in the direction indicated by the double arrows 16 and 17, respectively. The lower carriage 11 here moves twice as fast and twice as far as the upper carriage 10, both carriages, however, always moving in the same direction.

The layering belt 15 of the lower carriage 11 is guided by means of additional deflection guide rollers 13' to present two web conveying regions oriented at right angles to one another. Below the lower guide roller 13, there are provided two spaced removal, or layering, rollers 18 and 19 which are fixed to lower carriage 11. The web which is removed downwardly between the layering rollers 18 and 19 is deposited on a removal belt 20 whose longitudinal and movement direction extends transversely to the direction of movement of layering carriages 10 and 11.

If layering carriage 10 moves toward the left at a high layering speed, a bulge is produced in the web at the point of transfer to layering carriage 11, i.e., in the region of the right-hand guide roller 12, which bulge is transported on as a wrinkle in the web. To avoid this drawback, a plate 21 is provided at the side of the right-hand guide roller 12 which faces toward card 1 to prevent the creation of a horizontal air stream relative to the layering table 10. Plate 21 is fixed to upper carriage 10 by means of a connecting piece 22, and thus moves as a unit with carriage 10. The edges of plate 21 which face the delivery belt 9 and the layering belt 15 are provided with flexible sealing strips 23.

During the back and forth movement of the layering carriage 11, the creation of air streams relative to the carriage in the horizontal direction may produce flaws in the web in the region of the vertically oriented supporting surface of the layering belt 15 and layering rollers 18 and 19, such flaws being depicted at 24 and 25. The flaw 24, in the form of a bulge, would occur when layering carriage 11 is moving in the direction toward the card 1, i.e., toward the right; when layering carriage 11 is moving toward the left, the bulge 25 can be created in the area between the lower roller 13 and layering roller 19.

In order to prevent appearance of the two last described flaws in the web, a plate 26 serving as an air deflector is provided in front of the left side of the supporting surface defined by layering belt 15, which plate is fixed to layering carriage 11 by one or a plurality of connecting elements 27 and is provided with a flexible sealing strip 28 at its edge adjacent the lower reach of layering belt 14. In addition, a plate 29 also serving as an air deflector is positioned to that side of the gap between lower roller 13 and layering roller 19 which is directed toward card 1 and is fixed to carriage 11 by a connecting element 30 secured to the bearing of a roller 13' and a connecting element 31 secured to the bearing of layering roller 19. Plate 29 is provided with a flexible sealing strip 32 at its edge adjacent the lower reach of belt 15.

When the layering machine is operated at high layering speeds of, for example, 80 m/min there exists the danger that the uppermost web layer edges 3' and 3'' will flip over under the action of the air streams generated by the movement of layering carriage 11, which streams reverse their direction with a time delay after the direction of carriage movement reverses, thereby producing particularly intensive surges of air directed toward the center of the removal belt 20 just after each direction reversal by carriage 11, which surges have the effect of lifting the web layers.

In further accordance with the invention, such flipping over of the edges of the layers is prevented by two foot plates 33 and 34 which are arranged at respectively opposite sides of removal rollers 18 and 19 and which are inclined slightly, preferably by an angle of no more than 25°, with respect to the supporting surface of removal belt 20. These foot plates 33 and 34 shield the layer edges 3' and 3'' against the above-mentioned surges of air until they have lost their effect.

In this connection it has been found to be advantageous for the foot plate 33, which is inclined upwardly toward the left, and is located to the side of rollers 18 and 19 which is directed away from card 1, to have in front of it an additional sheet metal piece 35 which is inclined to the supporting surface of removal belt 20, the additional plate 35 here being upwardly inclined toward the center of belt 20, and toward card 1, and having the same direction of inclination of foot plate 34. The minimum vertical distance 40 between each of plates 33 and 34 and the supporting surface of belt 20 is preferably no greater than 60 mm.

According to a particularly preferred embodiment of the present invention, the additional plate 35 is spaced from its associated layering roller 18 by a distance 36 preferably of 10 to 50 mm. By suitable selection of the value for the distance 36 between the lower edge of additional plate 35 and the surface of layering roller 18, it is possible to utilize the air pumping effect produced between plates 26 and 21 due to the difference in speed between layering carriages 10 and 11 to aid in preventing flaws in the web. This pumping effect produces an underpressure between plates 21 and 26 when carriages 10 and 11 are traveling away from card 1 and an excess pressure when the carriages are moving toward card 1 and the resulting air streams will help to pevent the formation of flaws in the web.

According to a modification of the embodiment illustrated in the FIGURE, the apparatus may also be designed so that an air guiding device which corresponds in structure to plate 21 is associated with the second delivery table 7. The additional plate is here diposed to the left of table 7 and is fixed with respect thereto by means of one or more suitable connecting elements. This additional plate is provided with a sealing strip at its lower edge which faces layering belt 14 and extends above the upper reach of belt 9.

It will be understood that the above description of the present invention is susceptible to various modifications, changes and adaptations, and the same are intended to be comprehended within the meaning and range of equivalents of the appended claims.

What is claimed is:

1. In a machine for layering a web of textile fibers, composed of a plurality of web conveying units including a stationary web delivery unit, a first layering carriage unit mounted to undergo a back and forth movement and to receive a fiber web from the delivery unit, a further layering carriage unit disposed in sequence with the first layering carriage unit and mounted to undergo a back and forth movement, an additional layering unit movable together with the further layering carriage unit for conveying a web away from the further layering carriage unit, and a transporting unit for transporting a layered web from the additional layering unit, the improvement comprising air guidance means located at a region of transfer of such a web between two of said units for forming an air guidance channel with said two units to create, during conveyance of a web in a web layering procedure, an air stream traveling substantially tangentially to the direction of travel of the web.

2. An arrangement as defined in claim 1 wherein said air guidance means comprise a plate fixed relative to one of said units with which it forms an air guidance channel.

3. An arrangement as defined in claim 2 wherein said plate is fastened to said one of said units.

4. An arrangement as defined in claim 3 wherein the other one of said units with which said plate forms an air guidance channel includes a web conveyor member presenting a moving surface and said air guidance means comprise a flexible sealing strip connected to said plate and engaging said moving surface.

5. An arrangement as defined in claim 4 wherein said additional layering unit comprises a pair of spaced layering rollers between which the web passes, and said transporting unit includes a supporting surface for receiving the web in layered form from said rollers, and further comprising two foot plates fixed relative to said additional layer unit and each disposed to a respective side thereof and adjacent a respective one of said layering rollers, inclined at no more than a small angle to said transporting unit supporting surface and spaced a small distance above said supporting surface for influencing the flow of air in the vicinity of the layered web deposited on said supporting surface.

6. An arrangement as defined in claim 5 wherein said small distance between said foot plates and said supporting surface is no greater than 60 mm.

7. An arrangement as defined in claim 6 wherein said foot plates are inclined at an angle of no greater than 25° with respect to said supporting surface.

8. An arrangement as defined in claim 7 further comprising an additional plate carried by that one of said foot plates which is disposed at the side of said additional layering unit directed away from said delivery unit and spaced from said layering roller adjacent said one foot plate by a distance of between 10 and 50 mm.

9. An arrangement as defined in claim 2 wherein said plate is fixed relative to said first layering carriage unit at a region of transfer between said web delivery unit and said first layering carriage unit.

10. An arrangement as defined in claim 9 wherein said further layering carriage unit is immediately adjacent said first layering carriage unit and said plate is further located at the region of transfer between said first and further layering carriage units.

11. An arrangement as defined in claim 2 wherein said plate is fixed relative to said further layering carriage unit and said additional layering unit and is located in the region of transfer of such a web therebetween .

12. An arrangement as defined in claim 2 wherein said air guidance means further comprises a further additional plate fixed relative to said further layering carriage unit and disposed parallel to the downstream portion of the conveying path defined by said further layering carriage unit.

* * * * *